US006217240B1

(12) United States Patent
Lee

(10) Patent No.: US 6,217,240 B1
(45) Date of Patent: Apr. 17, 2001

(54) DEVICE FOR CONTROLLING HEAD PRESSURE IN MINIATURE PRINTER

(75) Inventor: Kwang Young Lee, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/337,703

(22) Filed: Jun. 21, 1999

(30) Foreign Application Priority Data

Sep. 17, 1998 (KR) ..... 1998/17733
May 12, 1999 (KR) ..... 1999/16947

(51) Int. Cl.[7] ..... B41J 2/315
(52) U.S. Cl. ..... 400/120.16; 400/88; 347/197
(58) Field of Search ..... 400/120.16, 120.17, 400/88, 120.01; 347/197, 198

(56) References Cited

U.S. PATENT DOCUMENTS 4,560,292 * 12/1985 Takahasi ..... 400/586
5,040,461 * 8/1991 Van-Ocker ..... 101/288
5,148,187 * 9/1992 Ono et al. ..... 400/624
5,157,415 * 10/1992 Seyasu ..... 347/197
5,160,205 * 11/1992 Mistyurik ..... 400/208
5,309,176 * 5/1994 Faes et al. ..... 347/220
5,594,487 * 1/1997 Nuita et al. ..... 347/197
5,886,725 * 3/1999 Miyadera et al. ..... 347/197

FOREIGN PATENT DOCUMENTS 7-25084 1/1995 (JP) .
7-246751 * 9/1995 (JP) .

* cited by examiner

*Primary Examiner*—Daniel J. Colilla
(74) *Attorney, Agent, or Firm*—Renner, Otto, Boisselle & Sklar LLP

(57) ABSTRACT

A device for controlling the head pressure in a miniature printer is disclosed. A pair of hinge parts with an elongate shaft retaining slot in each of them are installed on the bottom of the head frame so as for a printer head to be closely contacted to the surface of a platen roller. Elastic members are fixed to the head frame, and a supporting bracket is installed in rear of the head frame across the elastic members so as to be pivoted together with the head frame, so that a stable running of the printer paper is ensured, and that the printing state is made clear. A shaft passes through the shaft retaining elongate slots, and thus, the head frame and a supporting bracket are secured on a base plate. A locking piece is installed in contact with the supporting bracket.

13 Claims, 6 Drawing Sheets

FIG. 3A
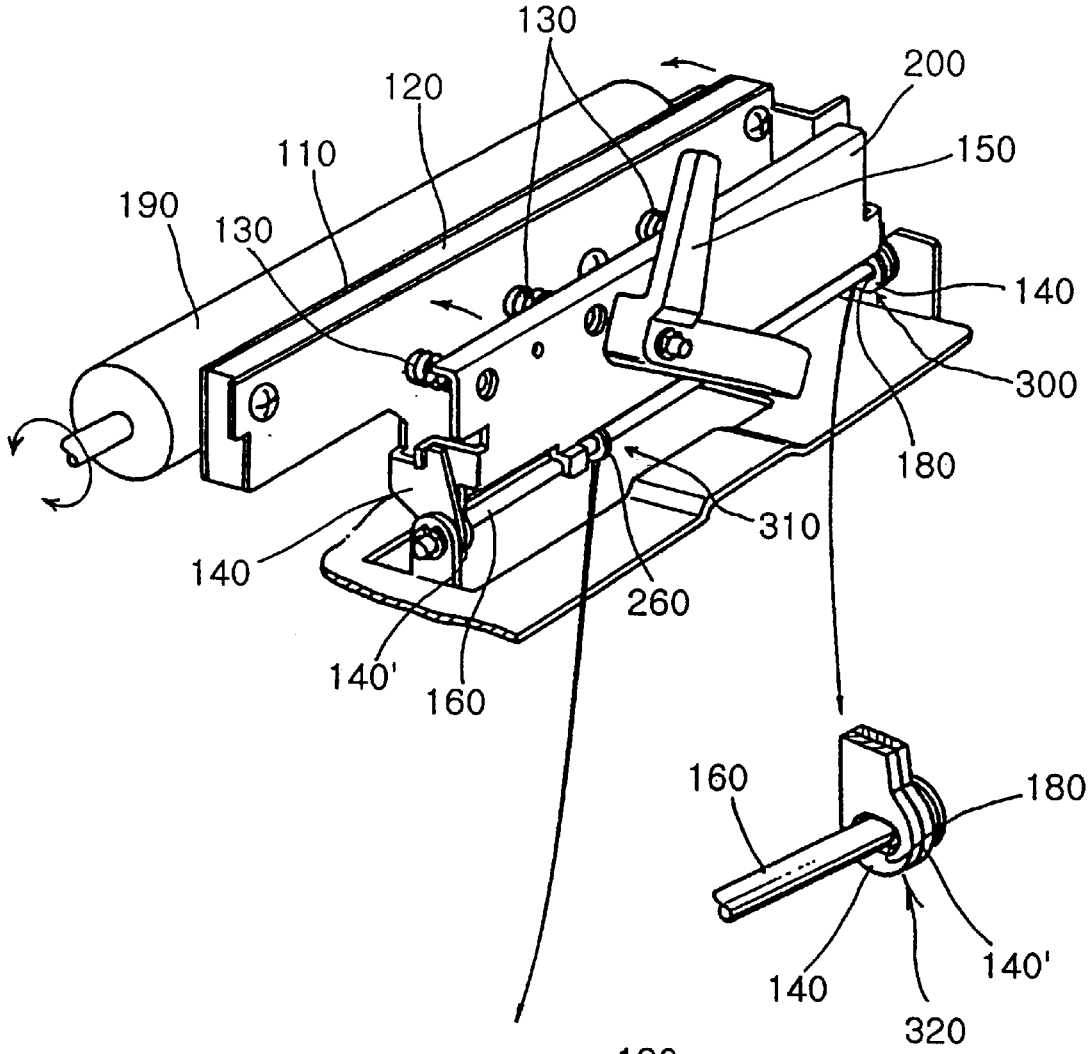
FIG. 3C
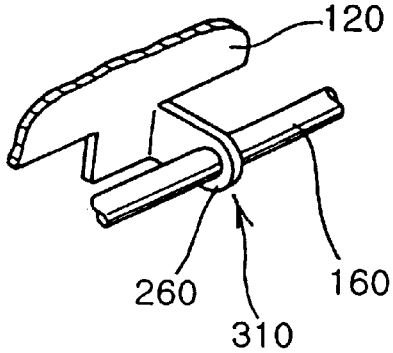
FIG.3B

DEVICE FOR CONTROLLING HEAD PRESSURE IN MINIATURE PRINTER

BACKGROUND OF THE INVENTION

1. Field of the Invention

The present invention relates to a miniature printer used in a cash register or the like. Particularly the present invention relates to a device for controlling the head pressure in a miniature printer, in which a pair of hinge parts with an elongate shaft retaining slot in each of them are formed on the bottom of a head frame so as for a printer head to be closely contacted to the surface of a platen roller. Elastic members are fixed to the head frame, and a supporting bracket is installed in rear of the head frame across the elastic members so as to be pivoted together with the head frame, so that a stable running of the printer paper is ensured, and the printing state is made clear.

2. Description of the Prior Art

In the generally known miniature printers used in a cash register or the like, as shown in FIG. 1, a printer head 10 is integrally formed with a head frame 12, and at the rear of the head frame 12, there is installed a supporting bracket 16 to be elastically supported by springs, so that the head frame 12 and the supporting bracket 16 would be elastically supported. A pair of hinge parts 18 are formed on the bottom of the head frame 12 and the supporting bracket 16.

Further, a shaft 22 is formed upon a base plate 20, and a locking piece 28 is pivotally installed on the rear face of the supporting bracket 16. When the lower end of the locking piece 28 contacts a projected step 24, the printer head 10 contacts a platen roller 26.

In the above described printer, the head frame 12 together with the printer head 10 is pivoted forward by a certain angle to be contacted to the platen roller 26 (the printing paper passes by the roller 26), thereby carrying out the printing. In this case, springs 14 are installed to the rear face of the head frame 12, and thus the supporting bracket 16 pivots together with the head frame 12. Thus if the locking piece 28 is turned downward, the supporting bracket 16 pivots around the shaft 22. Under this condition, the head frame 12 together with the printer head 10 pivots forward to make the printer head 10 contact the platen roller 26, and therefore, a printing operation is carried out on the paper which passes through the platen roller 26.

However, in the above described printer, the head frame 12 is pivoted in accordance with the pivoting of the locking piece 28. Therefore, when a contacting force acts on the platen roller 26, a part of the printer head 10 closely contacts with the platen roller 26 owing to the incoming paper, while gaps remain at either of the end portions of the printer head 10. Due to these gaps between the printer head 10 and the platen roller 26, a clear printing cannot be realized.

A printer related to this technique is disclosed in Japanese Patent Application Laid-open No. Hei-7-25084.

This printer is illustrated in FIG. 2. As shown in this drawing, springs 52 are secured to the rear face of a head frame 50, and a printer head 54 is supported by the springs 52. A platen rubber member 64 is supported by a shaft 58 which is secured on a base frame 56. Inside the platen rubber member 64, there are installed a main platen supporting member 62 and an auxiliary platen supporting member 60, so that the platen rubber member 64 can be closely contacted to the shaft 58. Further, the platen supporting members 60 and 62 respectively have contacting parts 66' and 66. A printing paper roll 68 is disposed on a side of the base frame 56.

In the above described printer, when the printer head 54, which is elastically supported by the springs 52 of the head frame 50, is contacted to the platen rubber member 64, the platen rubber member 64 contacts both of the contacting parts 66' and 66, and therefore, a stable position is maintained all the time. The contacting parts 66 and 66' which are formed respectively within the platen supporting members 60 and 62 contact with the shaft 58 so as to be rotated together with the shaft 58. Accordingly the printer head 54 stably contacts with the platen rubber member 64, thereby carrying out a printing on the paper of the paper roll 68.

However, the printer head 54 which closely contacts with the platen rubber member 64 always contacts with a side of the base frame 56. Therefore, if the platen supporting members 60 and 62 are damaged, then a part of the printer head 54 contacts with the platen rubber member 64, while a gap is formed between the other ends of the printer head 54 and the platen rubber member 64. At this situation, the adjustment of the gap is very difficult, and therefore, the printing quality is aggravated, or the paper is ejected in a skew posture, or the paper may be jammed.

SUMMARY OF THE INVENTION

The present invention is intended to overcome the above described disadvantages of the conventional techniques.

Therefore it is an object of the present invention to provide a device for controlling the head pressure in a miniature printer, in which a gap between a printer head and a platen roller is compensated by elongate slots of hinge parts, so that the contact between the platen roller and the printer head is improved, that a clear printing can be maintained, that a paper jam can be prevented to avoid the damage of the head, and that a running stability can be ensured to extend the life expectancy of the printer.

In achieving the above object, the device for controlling a head pressure in a miniature printer according to the present invention includes: a printer head installed on front of a head frame; a platen roller for carrying a printing paper in contact with the printer head; a supporting bracket connected through elastic members to the rear face of the head frame; a frame pivoting part with the head frame and the supporting bracket pivotally connected thereto; a frame supporting part installed on the head frame, for preventing a biasing of the frame pivoting part; a frame degapping part formed on the frame pivoting part, for making both ends of the head frame degapped; and a locking piece for preventing the pivoting of the supporting bracket back and forth.

In another aspect of the present invention, the device for controlling a head pressure in a miniature printer according to the present invention includes: a printer head installed on front of a head frame; a platen roller for carrying a printing paper in contact with the printer head; a supporting bracket connected through elastic members to the rear face of the head frame; a frame pivoting part with the head frame and the supporting bracket pivotally connected thereto; a frame supporting part installed on the head frame, for preventing a biasing of the frame pivoting part; a frame degapping part formed on the frame pivoting part, for making both ends of the head frame degapped; a locking piece for preventing the pivoting of the supporting bracket back and forth; a frame connecting part for connecting the supporting bracket to the head frame; and a bracket pivoting part for allowing the supporting bracket to move back and forth.

BRIEF DESCRIPTION OF THE DRAWINGS

The above object and other advantages of the present invention will become more apparent by describing in detail the preferred embodiment of the present invention with reference to the attached drawings in which:

FIG. 3 (consisting of FIGS. 3A, 3B and 3C) illustrates the miniature printer according to the present invention, in which a printer head, a head frame, a supporting bracket and a hinge part are included;

DETAILED DESCRIPTION OF THE PREFERRED EMBODIMENT

Figures 1A, 1B:
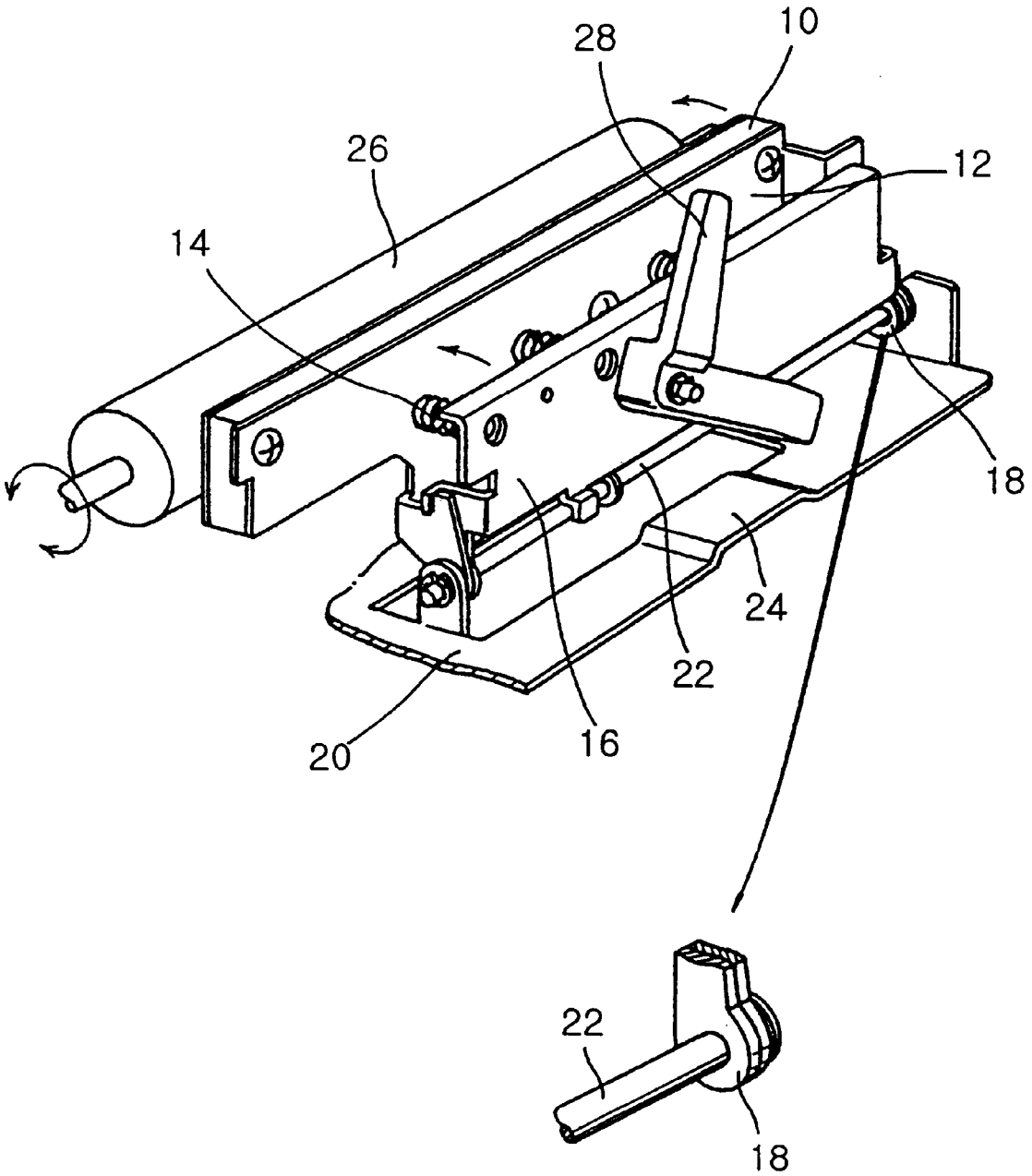
FIG. 1 (consisting of FIGS. 1A and 1B) schematically illustrates the critical portion of the general miniature printer.
Figure 2:
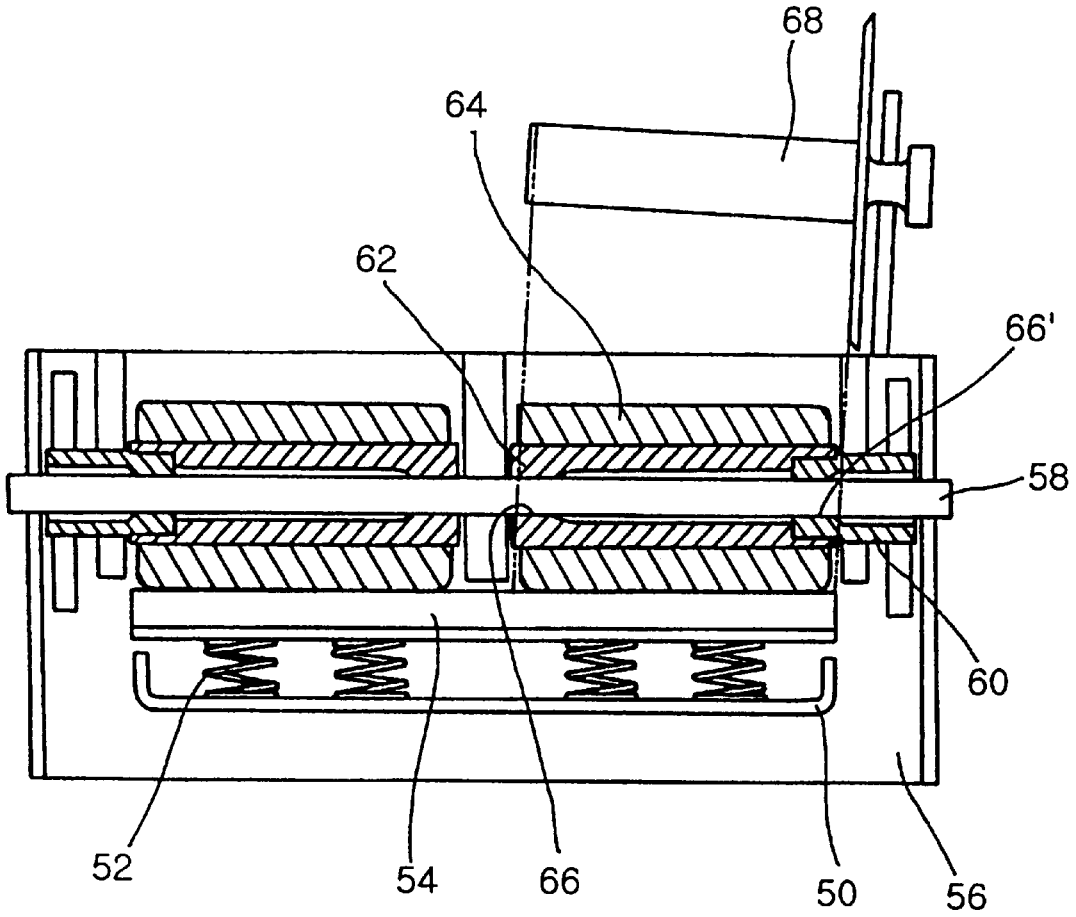
FIG. 2 is a sectional view showing a conventional miniature printer.
Figure 4:
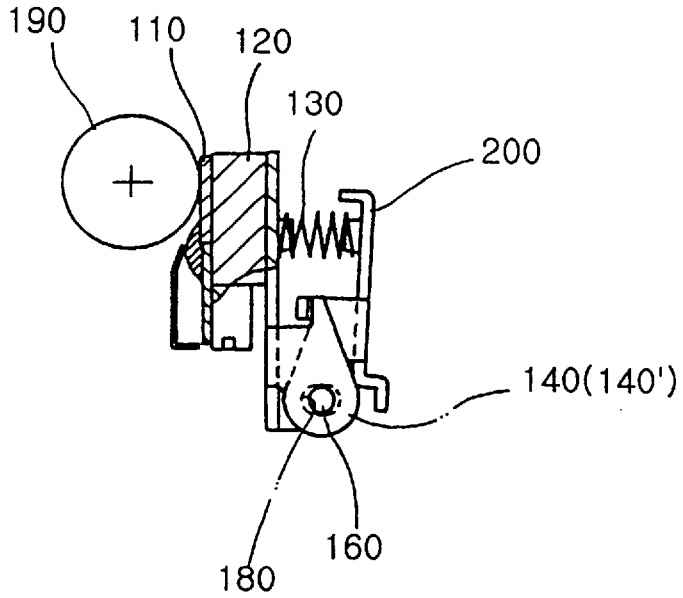
FIG. 4 illustrates the coupling of the supporting bracket to the head frame according to the present invention.
Figure 5A:
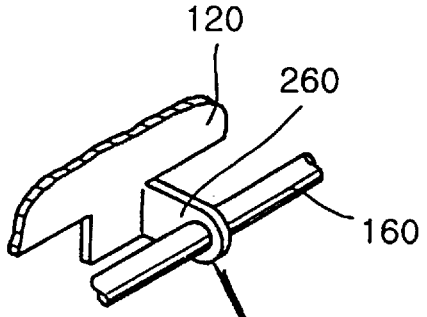
FIG. 5 (consisting of FIGS. 5A and 5B) is a sectional view showing the securing state of the shaft of the supporting bracket.
Figure 5B:
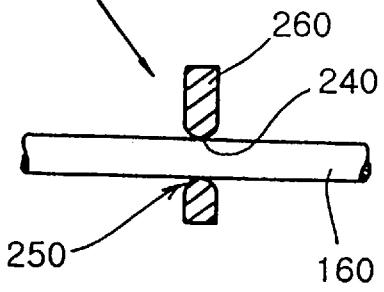

FIG. 3 illustrates the miniature printer according to the present invention, in which a printer head, a head frame, a supporting bracket and a hinge part are included. FIG. 4 illustrates the coupling of the supporting bracket to the head frame according to the present invention. FIG. 5 is a sectional view showing the securing state of the shaft of the supporting bracket. As shown in these drawings, elastic members 130 are installed on the rear side of a head frame 120 with a printer head 110 fixed thereto, so that the printer head 110 can be contacted to a platen roller 190. The other ends of the elastic members 130 contact with the front face of a supporting bracket 200, so that the supporting bracket 200 can be pivoted together with the head frame 120.

A frame pivoting part 300 is formed under the head frame 120 and the supporting bracket 200, so that the frame pivoting part 300 can be pivoted together with the head frame 120 and the supporting bracket 200. The frame pivoting part 300 includes hinge parts 140 and 140' to secure the bottoms of the head frame 120 and the supporting bracket 200. A shaft 160 passes through the hinge parts 140 and 140', and is secured on a base plate 210.

A frame supporting part 310 is formed at an intermediate point of the head frame 120, for preventing the same direction movement of the both ends of the head frame 120. In this frame supporting part 310, an integral securing piece 260 protrudes from the bottom of the head frame 120, and the shaft 160 is inserted into a through hole 240 of the securing piece 260. That is, the securing piece 260 has the through hole 240 and a sloped part 250, so that the head frame 120 can be moved in both directions.

A frame degapping part (device) 320 is provided to enable both ends of the head frame 120 to move in opposite directions while being secured to the shaft 160 by the securing piece 260. Such movement is permitted by reason of the hinge parts 140 and 140' respectively having elongate slots through which the shaft 160 extends.

A locking piece 150 is installed to prevent the back-and-forth movements of the supporting bracket 200 when the supporting bracket 200 contacts with the base plate 210.

Figure 6A:
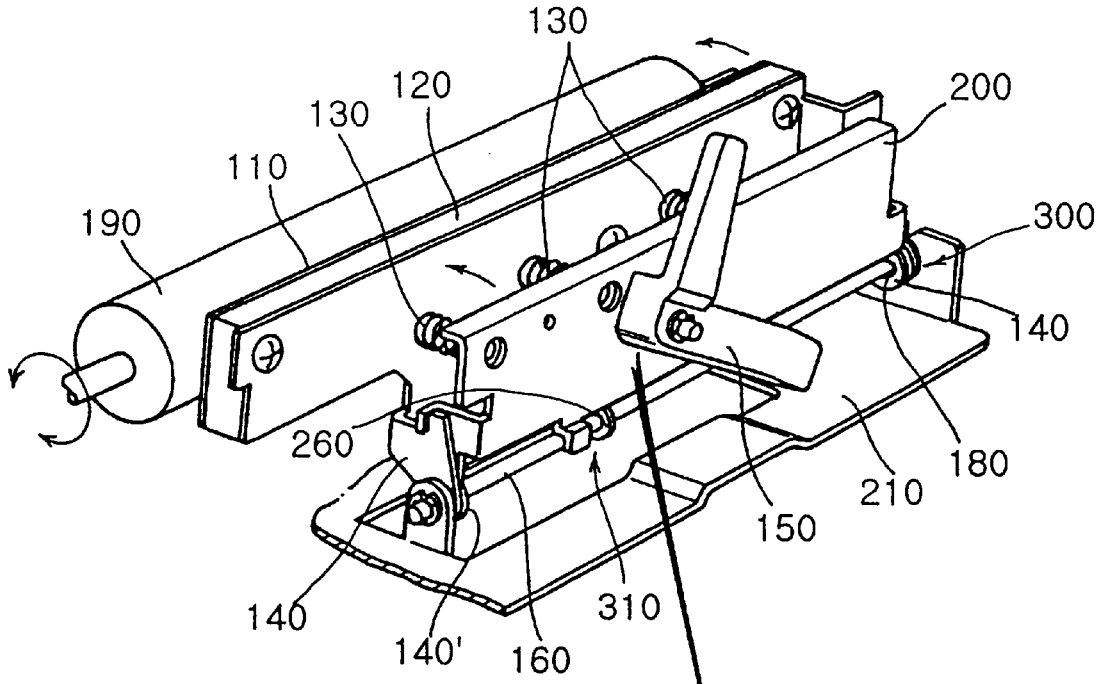
FIG. 6 (consisting of FIGS. 6A and 6B) is an exploded view showing the securing state of the locking piece for locking the supporting bracket in a second embodiment of the present invention.
Figure 6B:
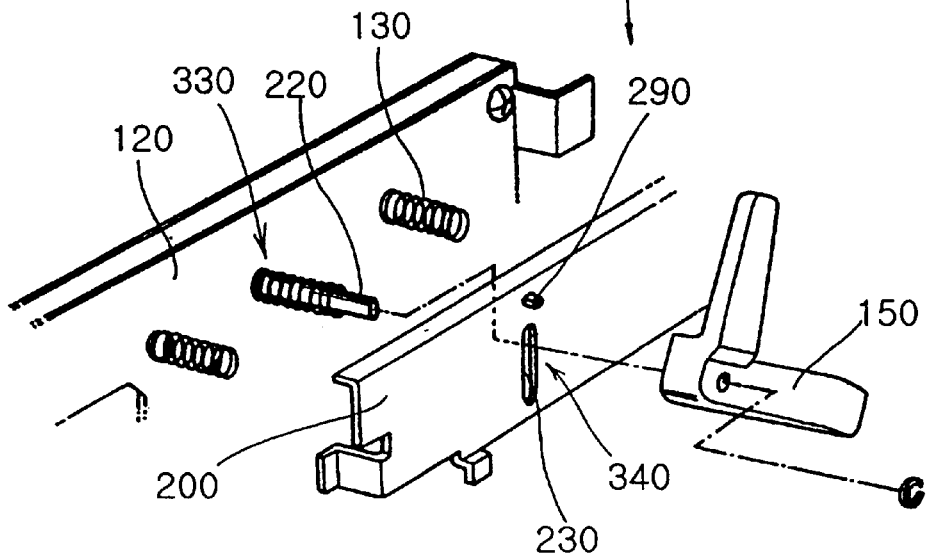
Figure 7A:
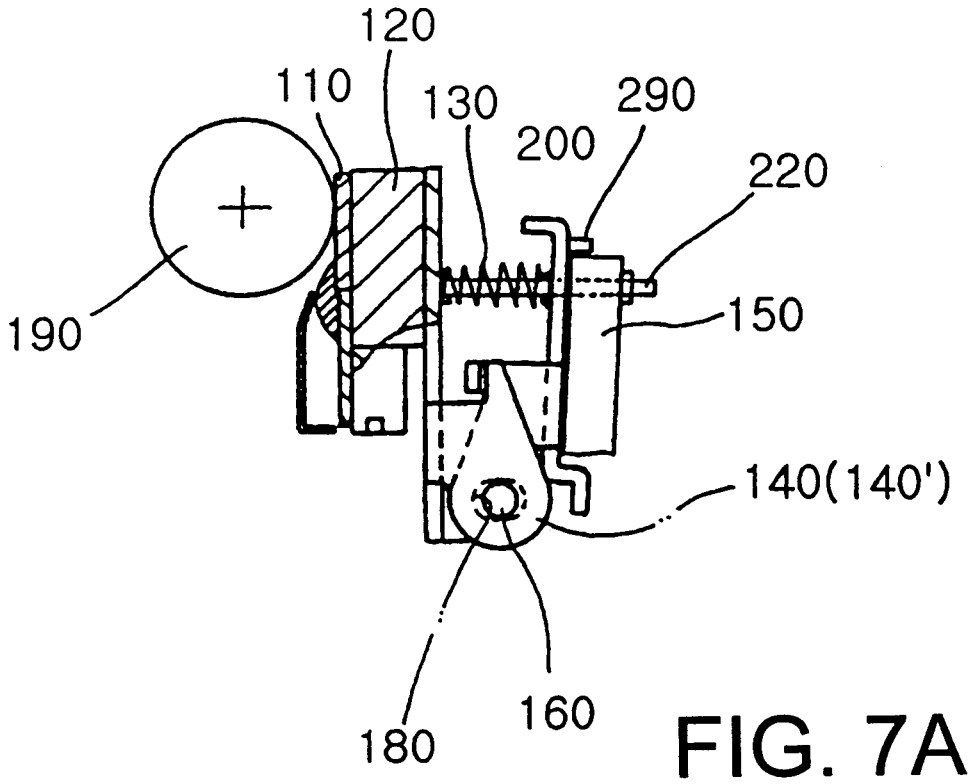
FIGS. 7A and 7B are sectional views showing the coupling between the head frame and the supporting bracket in the second embodiment of the present invention.
Figure 7B:
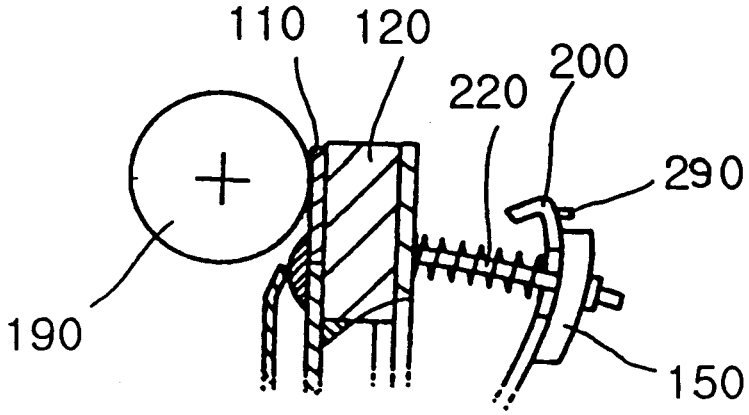

FIG. 6 is an exploded view showing the securing state of the locking piece 150 for locking the supporting bracket 200 in a second embodiment of the present invention. FIGS. 7A and 7B are sectional views showing the coupling between the head frame 120 and the supporting bracket 200 in the second embodiment of the present invention. Referring to these drawings, a plurality of elastic members 130 consisting of compression coil springs are installed between the supporting bracket 200 and the head frame 120. The head frame 120 is attached to a printer head 110, in such a manner that the printer head 110 contacts with the platen roller 190.

A frame pivoting part 300 which is formed beneath the head frame 120 and the supporting bracket 200 has hinge parts 140 and 140' to elastically support the head frame 120 and the supporting bracket 200. A shaft 160 passes through the hinge parts 140 and 140' to be secured on the base plate 210.

A frame supporting part 310 is formed at an intermediate point of the head frame 120, for preventing the same direction movement of the both ends of the head frame 120. In this frame supporting part 310, an integral securing piece 260 protrudes from the bottom of the head frame 120, and the shaft 160 is inserted into a through hole 240 of the securing piece 260. That is, the securing piece 260 has the through hole 240 and a sloped part 250, so that the head frame 120 can be moved in both directions.

A frame degapping part (device) 320 is provided to enable both ends of the head frame 120 to move in opposite directions while being secured to the shaft 160 by the securing piece 260. Such movement is permitted by reason of the hinge parts 140 and 140' respectively having elongate slots through which the shaft 160 extends.

A locking piece 150 is installed to prevent the back-and-forth movements of the supporting bracket 200 when the supporting bracket 200 contacts with the base plate 210.

A frame connecting part 330 is installed at the rear of the head frame 120, so that the supporting bracket 200 connected through the elastic members 130 to the head frame 120 can be unitizingly pivoted. The frame connecting part 330 includes a supporting bar 220 which is protrudently installed at the rear of the head frame 120.

A bracket pivoting part (device) is provided to permit up and down movement of the supporting bar 220 which extends rearwardly from the head frame 120 and through the supporting bar 220. The bracket pivoting part 340 includes an elongate vertical slot 230 in the supporting bar 220 and in which the supporting bar 220 can move up and down.

The device of the present invention constituted as above will now be described as to its actuation.

As shown in FIGS. 3 to 5, the printer head 110, which is unitizingly attached to the head frame 120 of the miniature printer (which is used in a cash register or the like), is made to contact with the platen roller 190. Then a printing paper is fed into between the platen roller 190 and the printer head 110, and at the same time, the platen roller 190 is rotated, thereby carrying out a printing.

A plurality of elastic members 130 consisting of compression springs are disposed between the head frame 120 and the supporting bracket 200, in such a manner that there should be maintained a certain distance between the head frame 120 and the supporting bracket 200. The locking piece 150 which is pivotally installed on the rear face of the supporting bracket 200 is made to pivot, so that the supporting bracket 200 would be pivoted, and that the printer head 110 would contact with the platen roller 190.

The head frame 120 together with the supporting bracket 200 is connected through the integral hinge parts 140 and 140' to the shaft 160 which is secured upon the base plate 210.

Thus, the head frame 120 together with the supporting bracket 200 is pivoted around the shaft 160. That is, the head frame 120 together with the supporting bracket 200 pivots forward so as for the printer head 110 to be contacted with the platen roller 190, thereby making it possible to carry out a printing.

Under this condition, the securing piece 260 which is formed at an intermediate position between the hinge parts 140 and 140' receives the shaft 160 to be supported by the securing piece 260, while each of the hinge parts 140 and 140' has an elongate slot 180 to loosely retain the shaft 160. Thus, the central portion of the head frame 120 is secured by the securing piece 260, while the both end portions of the head frame 120 can move in the opposite directions as much as the elongate slots 180 permit. Thus, when the both end portions of the head frame 120 move, the both end portions of the head frame 120 move in the opposite directions to each other.

Thus, the head frame 120 and the supporting bracket 200 can be pivoted forward by a certain angular degrees around the shaft 160 and the hinge parts 140 and 140' upon pivoting the locking piece 150 downward (the locking piece 150 being positioned at the center of the supporting bracket 200). Consequently, the printer head 110 which is unitizingly coupled to the head frame 120 is contacted to the platen roller 190.

Under this condition, each of the elongate slots 180 of the hinge parts 140 and 140' either has an arcuate shape correspondingly with the track of the pivoting of the head frame 120 for making the printer head 110 contact with the platen roller 190, or has a straight horizontal elongate form so as for the head frame move back or forth when the printer head 110 contacts the platen roller 190.

Therefore, even if there occurs a gap between the printer head 110 and the platen roller 190, the both end portions of the head frame 120 are slightly pulled or pushed in the opposite directions owing to the elongate slots 180 by being secured by the securing piece 260. Therefore, the printer head 110 can be made to be perfectly contacted to the platen roller 190 without any partial gaps.

Further, the securing piece 260 which is formed between the hinge parts 140 and 140' is positioned at the center of the head frame 120, so that the load of the head frame 120 at the both sides of the securing piece 260 would be equal to each other. The securing piece 260 has a through hole 240 to receive the shaft 160, and this securing piece 260 is for preventing the both end portions of the head frame 120 from moving in the same direction.

Further, the through hole 240 of the securing piece 260 together with the shaft 160 fixes the center of the head frame 120, while only the both end portions of the head frame 120 can freely move in the opposite directions as much as the elongate slots 180 permit. As a result, the printer head 110 perfectly contacts to the platen roller 190 without leaving any gap.

Further, the elongate slots 180 which are respectively formed in the hinge parts 140 and 140' and which are for receiving the shaft 160 may have a horizontally elongate shape, and thus, the both end portions of the head frame 120 can move straightly in the opposite directions when the supporting bracket 200 closely contact owing to the locking piece 150. Alternatively, the elongate slots 180 may have an arcuate shape, so that the both end portions of the head frame 120 can move along an arcuate track in the opposite directions.

Meanwhile, as shown in FIGS. 6 and 7, the head frame 120 is installed through the shaft 160 fixed to the base plate 210, and thus, the printer head 110 which is unitizingly coupled to the head frame 120 is made to contact with the platen roller 190.

Further, the supporting bracket 200 is coupled through a plurality of elastic members 130 to the head frame 120, and the hinge parts 140 and 140' are secured through the shaft 160 to the base plate 210, thereby unitizingly coupling the supporting bracket 200 to the head frame 120.

Here, if the locking piece 150 which is secured to the rear face of the supporting bracket 200 is turned to be fixed to the stepped portion of the base plate 210, the supporting bracket 200 exerts an elastic force to the head frame 120 through the elastic members 130.

Further, one end portion of a supporting bar 220 is inserted into one of the elastic members 130, and the other end portion of the supporting bar 220 is inserted into the vertical elongate guide slot 230 which is formed in the supporting bracket 200. Thus when the supporting bar 220 is secured by the locking piece 150, the elastic members 130 stably exert elastic forces to both the head frame 120 and the supporting bracket 200.

Thus the supporting bar 220 is inserted into the guide slot 230 of the supporting bracket 200 to be mated with the locking piece 150, so that the head frame 120 together with the supporting bracket 200 is elastically supported, and that the head frame together with the supporting bracket 200 can be pivoted. Therefore, any gap between the printer head 110 and the platen roller 190 is eliminated owing to the compression between the head frame 120 and the supporting bracket 200, and owing to the pivotal or straight movements of the head frame 120 together with the supporting bracket 200. That is the elimination of the gaps owes to the existence of the elongate vertical guide slot 230 and the elongate horizontal slots 180, thereby improving the contact between the printer head 110 and the platen roller 190. (Conventionally, the supporting bracket 200 is fixed, and only the head frame 120 moves.)

When the leading end of the supporting bar 220 of the head frame 120 is inserted into the guide slot 230, the side areas of the supporting bar 220 contact with the inside of the guide slot 230, so that the vertical movements of the both end portions of the head frame 120 can be prevented.

As shown in FIG. 7A, the supporting bar 220 which protrudes from the head frame 120 has a straight form, and when the supporting bar 220 is inserted into the guide slot 230, the supporting bar 220 is secured by the locking piece 150.

If a gap is formed between the platen roller 190 and the printer head 110, the supporting bar 220 of the head frame 120 advances backward to be freely moved up or down within the guide slot 230. In this manner, the contact between the platen roller 190 and the printer head 110 is improved.

Under this condition, when the locking piece 150 which secures the supporting bar 220 moves so as to move the supporting bar 220 up, the locking piece 150 is stopped by a protuberance 290.

Alternatively, as shown in FIG. 7B, the supporting bar 220 may have an arcuate form, and thus, when the arcuate supporting bar 220 is inserted into the guide slot 230, the locking piece 150 can maintain almost the same vertical position, and the sliding of the supporting bar 220 within the guide slot 230 can be minimized.

The supporting bracket 200 may be formed in an arcuate shape same as the track which it draws when moving. Under this condition, when the head frame 120 together with the supporting bracket 200 pivots around the shaft 160, the head frame 120 and the supporting bracket 200 draw the same arcuate track. Therefore, the locking piece 150 which contacts with the rear face of the supporting bracket 200 generates minimal frictions, when the head frame 120 and the supporting bracket 200 move.

If a gap occurs between the platen roller 190 and the printer head 110, the supporting bar 220 (with its leading end secured to the locking piece 150) freely moves, so that the gap between the platen roller 190 and the printer head 110 would be eliminated. If the head frame 120 moves back, the supporting bracket 200 also moves up or down in contact with the locking piece 150, and therefore, the contact between the platen roller 190 and the printer head 110 is improved.

Further, When the supporting bar 220 is pushed backward, the head frame 120 also easily moves back. Further, the supporting bracket 200 also moves up or down, so that the contact between the printer head 110 and the platen roller 190 can be improved, thereby making it possible to carry out a clear printing.

According to the present invention as described above, when the locking piece is pivoted, the gap between the platen roller and the printer head is eliminated owing to the existence of the horizontal elongate slots which loosely retain the shaft, thereby improving the contact between the platen roller and the printer head. Thus a clear printing quality can be maintained, and jamming of the paper can be prevented, with the result that the damage of the printer head due to the jamming can be prevented.

In the above, the present invention was described based on the specific embodiments and the drawings, but it should be apparent to those ordinarily skilled in the art that various changes and modifications can be added without departing from the spirit and scope of the present invention.

What is claimed is:

1. A device for controlling head pressure in a miniature printer, comprising:

a base plate;

a shaft mounted to said base plate;

a head frame;

a printer head installed on said head frame;

a platen roller for carrying a printing paper in contact with said printer head;

a supporting bracket connected through elastic members to a rear face of said head frame, said head frame and supporting bracket including at opposite ends thereof respective hinge parts for pivotal mounting to said shaft; and a locking piece for preventing rearward pivoting of said supporting bracket when in a locked position; and wherein said hinge parts include elongate slots through which said shaft extends for permitting the ends of said head frame and supporting bracket to move back and forth; and said head frame has disposed at the center thereof a frame supporting part which is supported against back and forth movement with respect to said shaft while allowing the opposite ends of said head frame to move back and forth in opposite directions relative to said shaft.

2. The device as claimed in claim 1, wherein said frame surporting part protrudes from the center of the bottom of said head frame and has a through hole receiving said shaft, and said through hole has oppositely sloped end portions.

3. The device as claimed in claim 1, wherein said elongate slots are straight.

4. The device as claimed in claim 1, wherein said elongate slots are arcuate.

5. The device as claimed in claim 1, wherein said locking piece is pivotally installed on said supporting bracket for movement into and out of contact with said base plate, and said locking piece prevents rearward pivoting of said supporting bracket when said locking piece contacts said base plate.

6. The device as claimed in claim 1, wherein said locking piece and said frame supporting part are aligned in a direction transverse to said shaft.

7. A device for controlling head pressure in a miniature printer, comprising:

a base plate;

a shaft mounted to said base plate;

a head frame;

a printer head installed on said head frame;

a platen roller for carrying a printing paper in contact with said printer head;

a supporting bracket connected through elastic members to a rear face of said head frame, said head frame and supporting bracket including at opposite ends thereof respective hinge parts for pivotal mounting to said shaft;

said hinge parts including elongate slots through which said shaft extends for permitting the ends of said head frame and supporting bracket to move back and forth;

said head frame having disposed at the center thereof a frame supporting part which is supported against back and forth movement with respect to said shaft while allowing the opposite ends of said head frame to move back and forth in opposite directions relative to said shaft;

a supporting bar extending rearwardly from said head frame and through a guide slot in said supporting bracket; and a locking piece connected to said supporting bar for preventing rearward pivoting of said supporting bracket when in a locked position.

8. The device as claimed in claim 7, wherein said supporting bracket has a protuberance to limit upward movement of said locking piece.

9. The device as claimed in claim 7, wherein said locking piece 150 secured on said supporting bracket 200 receives said supporting bar 220 to allow said supporting bar 220 to pass through itself so as to be exposed beyond a rear face of it.

10. The device as claimed in claim 7, wherein said locking piece has a recess on a side of it to facilitate its movements.

11. The device as claimed in claim 7, wherein said supporting bracket has an arcuate shape.

12. The device as claimed in claim 7, wherein said supporting bar has an arcuate shape.

13. The device as claimed in claim 7, wherein said frame supporting part and said locking piece are aligned in a direction transverse to said shaft.

* * * * *